US007142173B2

(12) United States Patent
Bentley

(10) Patent No.: US 7,142,173 B2
(45) Date of Patent: Nov. 28, 2006

(54) KINETIC DEVICE AND METHOD FOR PRODUCING VISUAL DISPLAYS

(76) Inventor: Arthur Lane Bentley, 10252 South 2375, East Sandy, UT (US) 84092

( * ) Notice: Subject to any disclaimer, the term of this patent is extended or adjusted under 35 U.S.C. 154(b) by 366 days.

(21) Appl. No.: 10/003,988

(22) Filed: Oct. 31, 2001

(65) Prior Publication Data

US 2003/0080924 A1 May 1, 2003

(51) Int. Cl.
*G09G 3/00* (2006.01)

(52) U.S. Cl. ..... 345/31; 345/39; 345/46; 345/82

(58) Field of Classification Search ..... 345/31, 345/46, 39, 82; 40/452, 447, 550; 348/44; 340/815.45, 815.4, 815.53
See application file for complete search history.

(56) References Cited

U.S. PATENT DOCUMENTS

| | | | | | |
|---|---|---|---|---|---|
| 1,711,859 | A | | 5/1929 | Samminiatelli | 345/31 |
| 3,737,722 | A | | 6/1973 | Scharlack | 315/209 |
| 3,823,550 | A | * | 7/1974 | Bergey | 368/69 |
| 3,846,784 | A | | 11/1974 | Sinclair | 340/336 |
| 3,958,235 | A | | 5/1976 | Duffy | 340/336 |
| 4,160,973 | A | | 7/1979 | Berlin | 340/718 |
| 4,162,493 | A | | 7/1979 | Ross et al. | 340/752 |
| 4,264,845 | A | * | 4/1981 | Bednarz | 315/323 |
| 4,298,868 | A | | 11/1981 | Spurgeon | 340/755 |
| 4,308,572 | A | | 12/1981 | Davidson et al. | 362/103 |
| 4,470,044 | A | | 9/1984 | Bell | 340/755 |
| 4,602,191 | A | * | 7/1986 | Davila | 315/76 |
| 4,689,604 | A | | 8/1987 | Sokol | 340/755 |
| 4,782,336 | A | | 11/1988 | Bailey | 340/752 |
| 4,983,031 | A | * | 1/1991 | Solomon | 353/10 |
| 5,036,442 | A | | 7/1991 | Brown | 362/102 |
| 5,081,568 | A | | 1/1992 | Dong et al. | 362/184 |
| 5,192,864 | A | | 3/1993 | McEwen et al. | 250/234 |
| 5,302,965 | A | | 4/1994 | Belcher et al. | 345/31 |
| 5,406,300 | A | | 4/1995 | Tokimoto et al. | 345/31 |
| 5,444,456 | A | | 8/1995 | Ohta et al. | 345/39 |
| 5,457,900 | A | * | 10/1995 | Roy | 36/137 |
| 5,548,300 | A | | 8/1996 | Tokimoto | 345/31 |
| 5,596,340 | A | | 1/1997 | Otomi | 345/31 |
| 5,670,971 | A | | 9/1997 | Tokimoto et al. | 345/31 |
| 5,748,157 | A | | 5/1998 | Eason | 345/31 |

(Continued)

OTHER PUBLICATIONS

Microsoft Computer Dictionary, 4th ed. (Microsoft Press, 1999), p. 102.*

(Continued)

*Primary Examiner*—Riohard Hjerpe
*Assistant Examiner*—Leonid Shapiro

(57) ABSTRACT

A visual display device is constructed which uses the "persistence of vision" effect of human vision and responds to kinetic motions of the user as the device is held and swung by an operator. Displays may consist of alphanumeric and graphic data with image symmetry not required. A micro-controller adjusts the display to conform to the speed and width of the users swing, synchronizing the display to the users motions. Both the user and viewers of the device are enabled to see the displayed images correctly oriented and stable within the path of the swinging device. The user is provided with visual and or audio feedback, which helps in coordinating a steady swing, and gives an indication of the orientation of the displayed data. The device is fabricated in such a way that costs are at a minimum, allowing this technology to be used in widespread disposable or reusable applications. The technology is expanded to displays in which the viewer provides the kinetic motion and the device is held stationary.

8 Claims, 9 Drawing Sheets

U.S. PATENT DOCUMENTS

| | | | | |
|---|---|---|---|---|
| 5,791,966 | A | 8/1998 | Capps et al. | 446/242 |
| 5,826,036 | A * | 10/1998 | Nakagawa et al. | 709/247 |
| 6,175,354 | B1 | 1/2001 | Blissett et al. | 345/110 |
| 6,177,877 | B1 | 1/2001 | Munyon | 340/815.4 |
| 6,239,774 | B1 * | 5/2001 | Altman | 345/31 |
| 6,249,998 | B1 * | 6/2001 | NakaMats | 40/452 |
| 6,265,984 | B1 * | 7/2001 | Molinaroli | 340/815.4 |
| 6,319,425 | B1 * | 11/2001 | Tasaki et al. | 252/301.36 |
| 6,404,409 | B1 * | 6/2002 | Solomon | 345/31 |

OTHER PUBLICATIONS

The Picture Stick by Scott Edwards Electronics Now, Oct. 1994 V65 N10 P35.

Whirlessgig by Eric Smith (c) 1995 www.brouhaha.com/~eric/pc/whirlessgig.html.

Magic Wand (c) 2001 Exploratorium Recipe No. 110 (c) 1980 Exploratorium.

Exploratorium Exhibit Services—Catalog, Triple Eye Lightstick (c) 2000 website www.exploratorium.edu/exhibit_services/exibits/t/tropleeyelightstick.html.

Exploratorium Exhibit Services—Catalog, Pesistence of Vison (c) 2000 website www.exploratorium.edu/exhibit_services/exibits/p/persistenceofvision.html.

Persistence of Vision www.exploratorium.edu/snacks/persistence_of_vision.html (c) 1997 The Exploratorium 3601 Lyon Street San Francisco, CA. 94123.3

Whirling Watcher www.exploratorium.edu/snacks/whirling_watcher.html (c) 1997 The Exploratorium 3601 Lyon Street San Francisco, CA. 94123.

Skyliner Website www.theskyliner.com (c) 2000 Versatile Visions, Inc. P.O. Box 1151 Bangor Maine 0442.

* cited by examiner

KINETIC DEVICE AND METHOD FOR PRODUCING VISUAL DISPLAYS

BACKGROUND

1. Field of Invention

This invention relates to visual displays, which are generated by relying on the observer's "persistence of vision" or the "after image effect" of human vision.

2. Description of Prior Art

The "after image effect" or the "persistence of vision" of the human eye is well known as a viable means of delivering readable displays to the brain. Devices, which have been used to produce such displays, will display small portions of an image at different times and locations, relying on the human brain to retain the momentary images and combine them into a whole picture. Such displays are visibly pleasing and seem to appear and hang in mid-air. Motion is an integral part of the production of an "after image" display. The device, which produces the display, may be moved through space or the observer may be moved. Either way, the phenomenon is effective and visual displays become perceptible by the brain.

Bell U.S. Pat. No. 4,470,044 teaches that saccadic eye movements can produce visual displays without moving the display device, but this is only effective when viewed at a distance, since minute eye movements cannot scan the required space when viewed in close proximity.

The "after image effect" relies on partial images delivered to the brain in rapid succession.

The human brain must retain the partial images long enough to construct a meaningful image out of them. The faster the partial images are presented to the eye/brain, the faster the brain can make sense of the image and perceive a visual display.

This phenomenon has been illustrated in various displays at the Exploratorium in San Francisco, Calif. and at other Exploratorium sites. The following internet sites are instructive on persistence of vision and the "after image effect".

http://www.exploratorium.edu/exhibit_services/exhibits/p/persistenceofvision.html http://www.exploratorium.edu/exhibit_services/exhibits/t/tripleeyelightstick.html Highly complicated and costly apparatus has been employed as in Belcher et al. U.S. Pat. No. 5,302,965 and in Sokol U.S. Pat. No. 4,689,604 to deliver precisely timed displays in order to attempt a stable display. Not only are the apparatus costly, but if they are not precisely synchronized with the motion of the display device, the display will not be stable and pleasing.

Some have attempted to synchronize the display to the motion of the device using an accelerometer, such as in Tokimoto et al. U.S. Pat. No. 5,406,300. This technique has proved to be too complicated and expensive for a low cost device.

Jim Phillips and Rich Ottosen demonstrated the after image effect with their Whirlessgig but it was hard to see the message displayed. They also suggest using an accelerometer to detect the swing of the device but this would make it prohibitively expensive as well as requiring periodic calibration and adjustment of the accelerometer. Their work is documented on the internet at http://www.brouhaha.com/~eric/pic/whirlessgig.html.

Users of prior art displays have been unable to see the display when it is directed away from them while demonstrating the device to others. This makes use of the display unreliable, since the user is never sure if the correct display is visible, or if this swing is producing a pleasing display.

Ohta et al. U.S. Pat. No. 5,444,456 attempts to remedy this lack of positive feedback problem, by using light guides to direct the display in two directions at once. This allows both the user and the viewer to see a display, but the user will always see a mirror image of what is being displayed for the viewer. Only symmetrical objects can be displayed correctly on both sides of the device. This limitation of only being able to display symmetrical objects is manifest in "The Picture Stick" by Scott Edwards. Published in Electronics Now, October 1994 v65 n10 p35. This device also lacked any method of synchronizing the display with the motion of the picture stick. The result is unstable, unpredictable displays. Prior art that is swung in a rotational manner has a similar problem of reversal since the display is visible through 360 degrees of rotation, most of which is displayed backwards.

If the kinetic motion of the swing or rotational device is not properly sensed, portions of the display may be reversed, bunched, shifted, jittery, too narrow, too wide, or not centered, rendering the display unusable.

Prior art has been heavy, cumbersome, and limited to a vertical row of light emitting elements, which limits the size and shape of the device.

Prior art has not be able to display large displays, or communicate large phrases, since they are limited to what can be displayed in one swing.

Determining what is to be displayed by prior art is complicated and time consuming. Data selection has been accomplished with complicated push button selection schemes without user feedback to verify correct programming. Users of the devices quickly become frustrated with the complicated device and lose interest in using it. Some devices have provided means for users to enter user defined display data. These means all suffer from highly complicated methods and means, which confuse and discourage users.

Sensors for synchronizing the display with the motion of the display device have been mounted at either end of the light-emitting array in prior art. This tends to distort the display since it was not sensed within the space of the visual image.

Prior art has only a single display mode, or method of display which severely limits the uses and applications of the device.

Prior art has stored display data as bit maps, which severely limits the number of characters that can be displayed and requires large amounts of expensive memory.

SUMMARY INCLUDING OBJECTS AND ADVANTAGES

In accordance with the present invention, we set forth a kinetic visual display device that makes use of "persistence of vision" or the "after image effect" of human vision. Visual data is presented to the viewer in a columnar piecewise fashion as the device is moved through space. The human brain translates the images viewed by the eye and combines them into a complete mental picture of text and graphics. This effect is so amazing and powerful that viewers often are surprised as text and graphics seem to appear and hang in mid-air. The invention synchronizes the display width and speed with the users kinetic actions. Adjustments are made to the display by a microcontroller, which detects the users motions through the use of an inertia reversal sensor which detects reversals in the direction of inertia. Users of the invention are provided with visual and or audio feedback, which allows them to adapt their kinetic motions to modify the display response and view the results of their motions. According to the present invention, the forgoing and other objects and advantages are attained by the invention which may be used to display visual data in an affordable fashion which makes the device able to be priced as a one-time-use disposable amusement. The device is easy to use and engenders fascination in people of all ages.

Objects and Advantages

Accordingly, several objects and advantages of the invention are to provide a simple, low cost, fun, easy to use, and reliable display device which employs the "persistence of vision" or the "after image effect" of human vision to deliver stable visual displays of graphic images and alphanumeric characters. Moving lighted array or moving observer modes are implemented which allow the device to adapt to any motion. The display data need not be symmetrical in form, since the display is actively normalized and adjusted for proper viewing, free of reversed, bunched, shifted, and non-centered displays. Display normalization is achieved using a simple and inexpensive inertia reversal sensor, which is mounted within the lighted array. Since the inertia reversal sensor is one of the members of the lighted array, the motion of the lighted array is accurately sensed. Adjacent inertia reversals are used to measure the user's half-cycle swings, while displays are produced only once per swing. This results in stable and accurately placed displays within the users half-cycle swing width. Displays are actively adjusted to adapt to changes in the motion of the device. This display normalization method does not require the use of an interval timer which allows the timing algorithm to be used with lower cost microcontrollers which may not have interval timers.

Audio and visual feedback are provided to the user, thereby indicating whether the display is properly showing. The user can then kinetically control the display by adjusting his swing width and speed to produce dynamic visual effects. Display data is stored in a compressed format, which greatly increases the amount of data that can be stored and displayed. The invention operates in several modes, which allow for easy selection and display of data. The invention is capable of being programmed by the user with custom display data. Transmission of display data to the device may be by means of radio, induction, infrared light, visible light, or other wired or wire-free means. The transmission makes use of very simple switching techniques, and may employ personal computers or other means of interface.

OTHER OBJECTS AND ADVANTAGES OF THE INVENTION ARE

The inertia reversal sensor provides a kinetic means for device activation, which eliminates the need for on/off or mode switches. The device is kinetically activated and adapts its function to the kinetic energy applied to the device. The frequency and duration of kinetic motion of the device is detected and used to turn the device on and off as well as to select which group of display data is to be displayed through the use of a menu system. If no user motion is detected, the device shuts off.

Dynamic visual effects can be achieved by using different color light emitting elements on each of a devices lighted arrays. Differing display data can also be displayed on each side of a multiple lighted array device, for a directionally active display.

The size of the lighted array may also be varied from less than an inch to many hundreds of feet. Lighted arrays can be virtually any shape or size and comprised of any size, shape, color or multicolor light emitting elements. Light elements may be light emitting diodes, incandescent light bulbs, light guides, lasers, Electro-Luminescent lamps, or any other light producing or reflective areas which can be electronically or mechanically controlled.

Multiple and slanted lighted array configurations are possible which produce high resolution visual displays which are capable of directing the human eye in the direction that produces the best quality display.

Other pleasing displays can be accomplished by attaching the display device to moving objects such as automobile antennae, bicycle wheel, fan, etc. Still other methods of display involve a stationary display and rely on the motion of the observer and can be integrated onto objects such as clothing, badges, notebooks, or built into any object.

The device can be custom programmed for customers after manufacture. This greatly lowers the costs involved with producing devices to customer order. Advertising can be printed on the device as well as programmed into the visual displays.

Still further objects and advantages will become apparent from a consideration of the ensuing description and accompanying drawings.

REFERENCE NUMERALS

Figure 1:
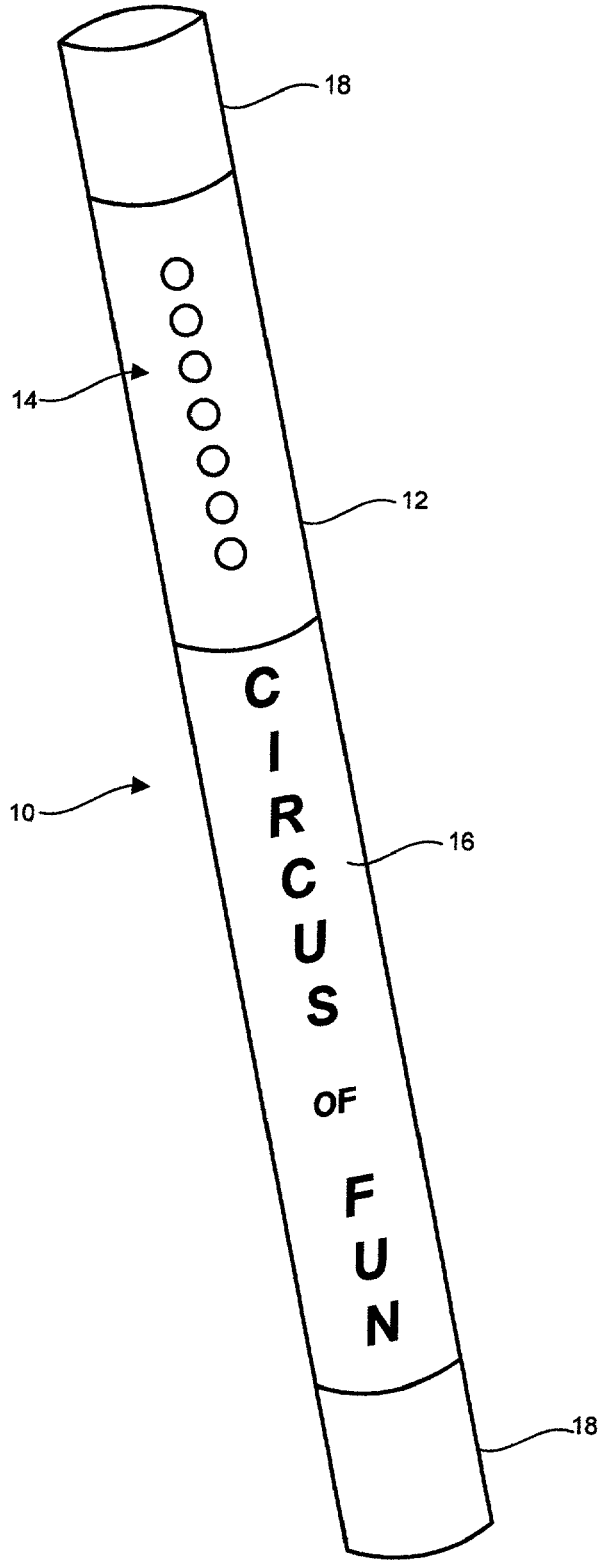
FIG. 1 is a perspective view of the invention.

10 preferred embodiment
12 clear tube
14 lighted array
15 rear lighted array
16 handle
18 end cap
20 printed circuit assembly
22 light emitting element
24 printed circuit board (PCB)
26 microcontroller
28 inertia reversal sensor
30 top mounted sensor
32 bottom mounted sensor
34 metallic bead
36 metal wire
38 right sensor contact
40 left sensor contact
42 battery contact
44 copper traces
46 other components
48 alternate inertia reversal sensor
50 metallic slug
52 metallic tube
54 conductive tube mounts
56 Sleep
58 Test Kinetic Shake
60 Run
62 Shutdown Warning
64 No Motion
66 Motion
68 Incorrect Shake Speed
70 Correct Shake Speed
72 Wake Up
74 Display Column
76 Count Column
78 Detected Right Inertia Reversal?
80 timeout
82 Done With Display?
84 Display Blank Columns
86 Calculate New Timing For Display
88 Detected Left Inertia Reversal?
90 Turn Off Display
92 360 degree light stick
94 cylindrical light emitting element
96 central metallic post
98 concentric metallic spring
100 concentric metallic cylinder
102 left metallic post
104 right metallic post
106 badge
108 graphic design
109 curved lighted array
110 angled lighted array
112 offset lighted arrays
114 character lighted array
116 picture lighted array
118 star light element
120 moon light element
122 smile face light element
124 light puzzle
126 left puzzle light array
126A left puzzle light array
128 right puzzle light array
128A right puzzle light array
130 compound lighted array
132 red element
134 white element
136 blue element
138 striped portion Preferred Embodiment—Description As shown in FIG. 1, the preferred embodiment 10 consists of a clear tube 12 and a lighted array 14. The lower portion of the tube forms a handle 16 and allows the assembly to be waved back and forth. The two ends of the clear tube 12 are plugged with an end cap 18. The handle 16 forms a battery holder for powering the device and can be accessed by removing the lower end cap 18. The handle 16 also may be labeled with advertising, instructions, and other attention getting graphics.

Figure 2:
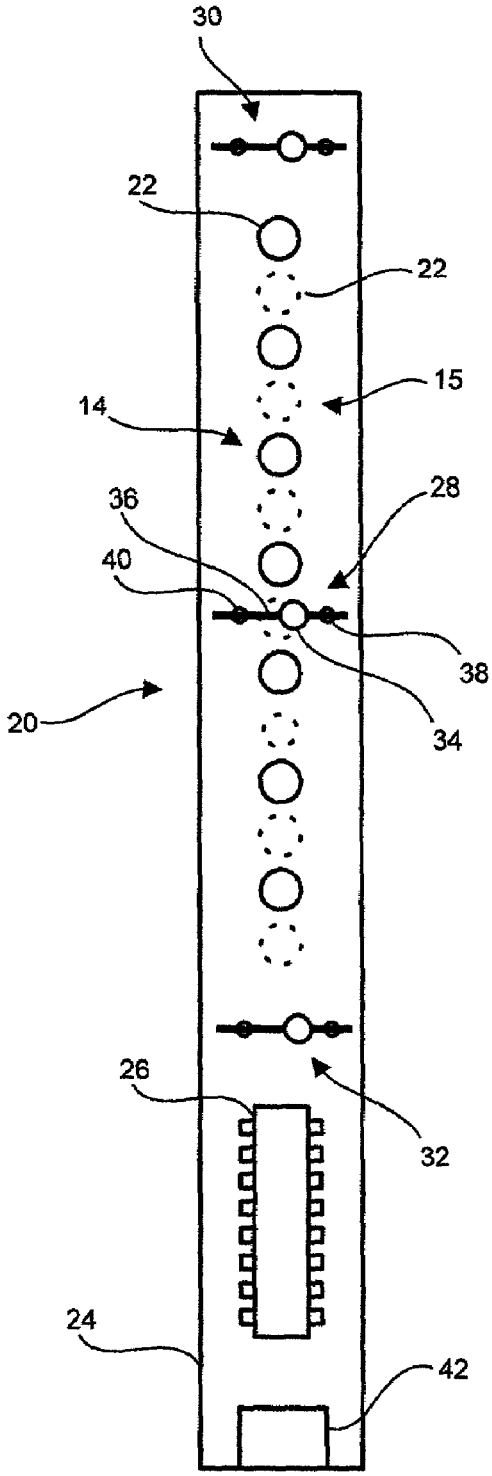
FIG. 2 shows the electronic circuit board of the preferred embodiment of the invention.

A detailed view of the lighted array 14 can be found in FIG. 2, which shows a fully populated printed circuit assembly 20. The lighted array 14 is made up of a plurality of light emitting element 22. The printed circuit board (PCB) 24 may also include a rear lighted array 15 which consists of a single or plurality of light emitting element 22 mounted on the backside of the printed circuit board (PCB) 24. A microcontroller 26 is mounted on the printed circuit board (PCB) 24 and controls the lighted array 14 and any rear lighted array 15.

A battery contact 42 is shown in FIG. 2 and contacts the positive side of the battery (not shown).

The printed circuit assembly 20 includes an inertia reversal sensor 28. The inertia reversal sensor 28 consists of a metallic bead 34 threaded on a metal wire 36. A right sensor contact 38 and left sensor contact 40 complete the inertia reversal sensor 28.

The inertia reversal sensor 28 must be mounted within the lighted array 14. Alternate placements of the inertia reversal sensor 28 are shown to be top mounted sensor 30, relative to the first light emitting element 22, or bottom mounted sensor 32, relative to the last light emitting element 22 of the lighted array 14, thereby becoming part of the lighted array 14.

Figure 3:
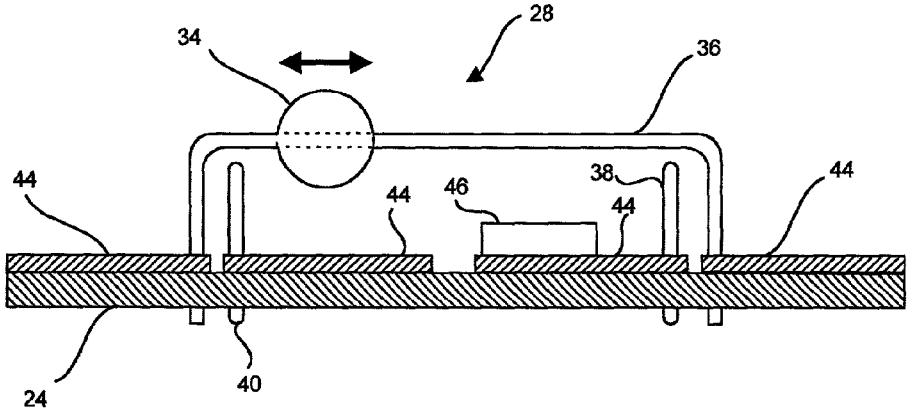
FIG. 3 shows the preferred inertial reversal sensor using a metal bead.

A detailed drawing of the aforementioned inertia reversal sensor 28 is shown in FIG. 3 and consists of metallic bead 34 threaded onto a metal wire 36. Right sensor contact 38 and left sensor contact 40 are placed at the right and left respectively of the metal wire 36.

The metal wire 36 and contacts 38 and 40 are connected to the printed circuit board (PCB) 24 by soldering to the copper traces 44 on the printed circuit board (PCB) 24. The sensor can be mounted over the top of other components 46 on the printed circuit board (PCB) 24 or the sensor can be mounted close to the surface of the printed circuit board (PCB) 24 such that the metallic bead 34 clears the printed circuit board (PCB) 24 and can slide freely. Left sensor contact 40 and right sensor contact 38 can be replaced with copper traces 44 if the sensor is mounted close to the printed circuit board (PCB) 24 surface.

Figure 4:
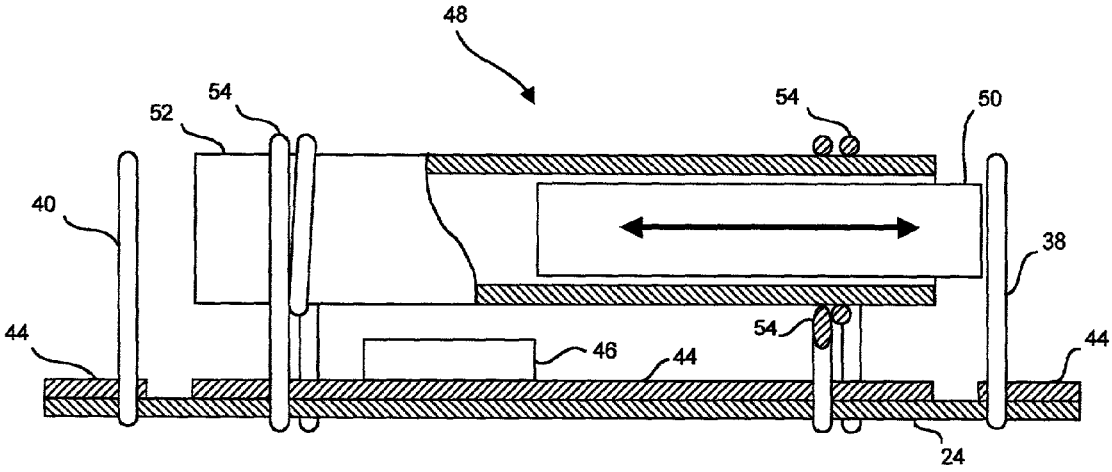
FIG. 4 shows an alternate inertia reversal sensor, which uses a metal tube and slug for detection.

FIG. 4 illustrates an alternate inertia reversal sensor 48 in the preferred embodiment. This alternate inertia reversal sensor 48 consists of a metallic slug 50 which slides freely in a metallic tube 52. The metallic tube 52 is either soldered directly to copper traces 44 on the printed circuit board (PCB) 24 or is mounted over the top of other components 46. Conductive tube mounts 54 are electrically connected to the metallic tube 52 and serve to the attach it to the printed circuit board (PCB) 24 when mounting it on top of other components 46.

Figure 5:
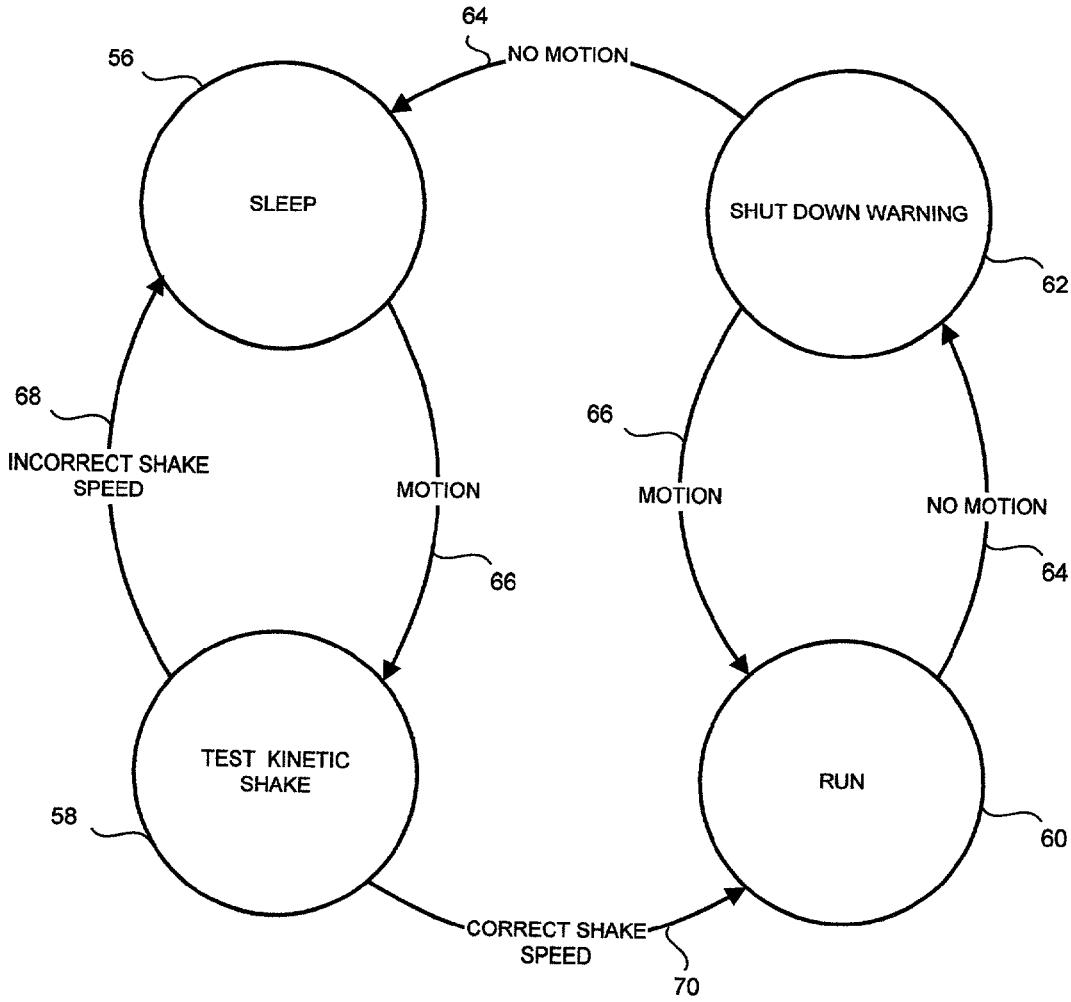
FIG. 5 is a state diagram showing the operating modes of the invention.

The invention operates in four states a shown in FIG. 5. The states are: Sleep 56, Test Kinetic Shake 58, Run 60, and Shutdown Warning 62. The invention detects the inertial reversals, which it encounters with inertia reversal sensor 28 and changes its operational state based on what was detected. The following motions are detected: No Motion 64, Motion 66, Incorrect Shake Speed 68, and Correct Shake Speed 70.

Figure 6:
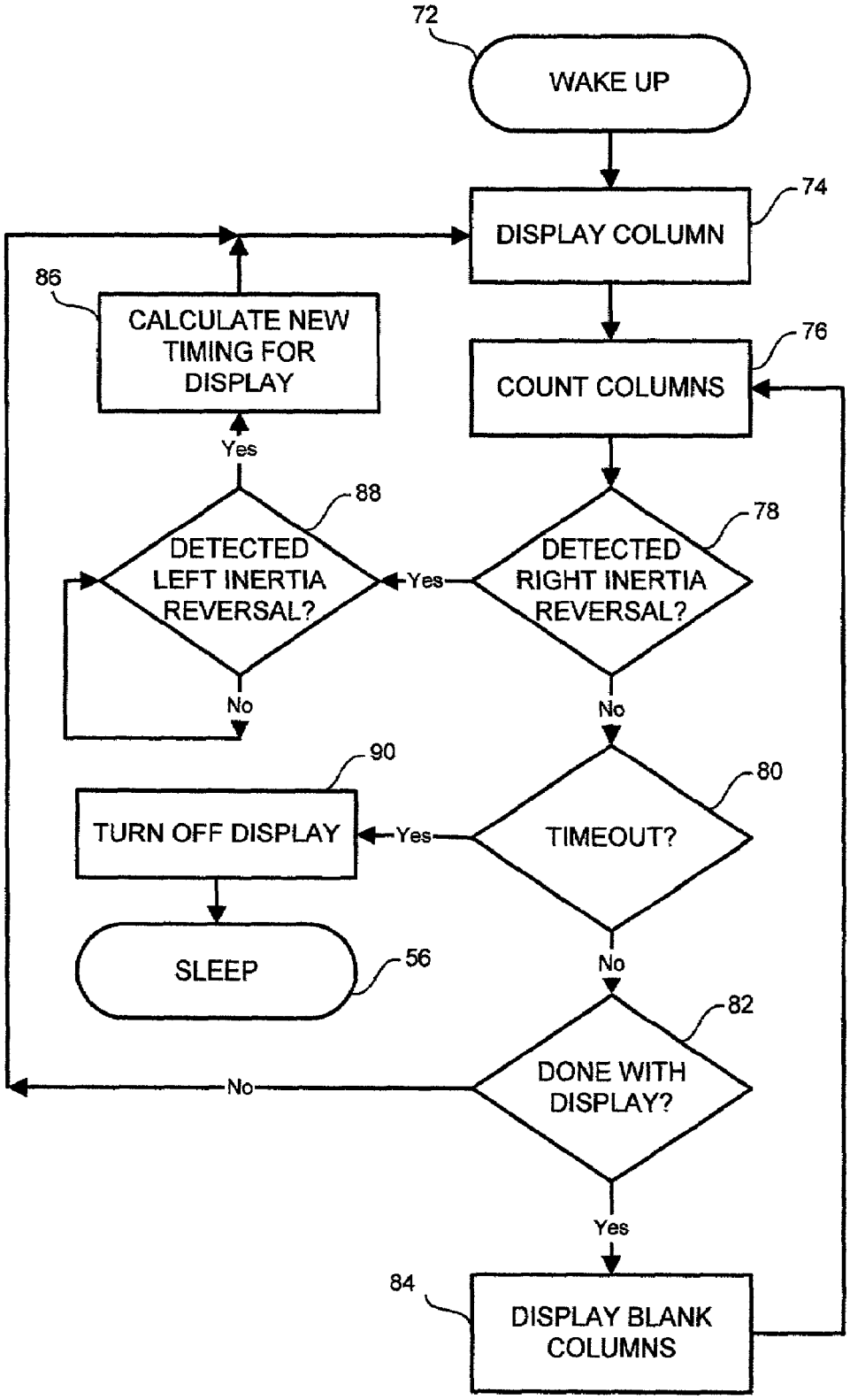
FIG. 6 is a flowchart showing the operation of the preferred embodiment.

The preferred method of display is diagramed in FIG. 6. The display is produced by effecting the following decisions and outputs: Wake Up 72, Display Column 74, Count Column 76, Detected Right Inertia Reversal? 78, Timeout 80, Done With Display? 82, Display Blank Columns 84, Calculate New Timing For Display 86, Detected Left Inertia Reversal? 88, Turn Off Display 90, and Sleep 56. The function of these outputs and decisions will be discussed hereafter.

Preferred Embodiment—Operation

The preferred embodiment of the invention is a hand held device as illustrated in FIG. 1, which is waved back and forth in the air by the user. As shown in FIG. 1, the preferred embodiment 10 consists of a clear tube 12 and a lighted array 14. The lower portion of the tube forms a handle 16 and allows the user to grasp the assembly and wave it back and forth. The two ends of the clear tube 12 are plugged with an end cap 18. The handle 16 also may be labeled with advertising, instructions, and other attention getting printing. Part of the novelty of the device is its low part count, low cost of construction which allows it to be effectively used in marketing and advertising applications which require a nearly "throw away" product with a limited, but impressive lifetime. The handle 16 is of a length which allows ample room for advertisements and other labeling as well as providing a long enough lever arm for easy swinging of the lighted array 14. The handle 16 also forms a battery holder for powering the device and can be accessed by removing the lower end cap 18.

A detailed view of the lighted array 14 can be found in FIG. 2, which shows a fully populated printed circuit assembly 20. The lighted array 14 is made up of a plurality of light emitting element 22. These light emitting element 22 may be of any variety which are able to be rapidly turned on and off and are light emitting diodes in the preferred embodiment of the invention. Light elements may be light emitting diodes, incandescent light bulbs, light guides, lasers, Electro-Luminescent lamps, or and other light producing or reflective areas which can be electronically or mechanically controlled.

The printed circuit board (PCB) 24 may also include a rear lighted array 15 which consists of a single or plurality of light emitting element 22 mounted on the backside of the printed circuit board (PCB) 24. This rear lighted array 15 is essential to producing a pleasing display for any viewers who surround the user while operating the display. One of the applications of the preferred embodiment is to display messages in the air to be viewed by other people facing the display. Single sided displays provide no feedback to the user to indicate what is being displayed, how big it is, or where it is located in the display. The rear lighted array 15 provides feedback to the user by displaying a copy of the display, properly oriented so he can tell exactly what is being displayed. Since the display adapts to the users swing width and rate, the rear lighted array 15 also indicates how wide the characters and graphics are that are displayed. The rear lighted array 15 may be as few as one light emitting element 22. One light emitting element 22 can be used to provide feedback to the user by placing a dot at the beginning of each display swing and another dot at the end of each display swing. In this way, by watching the rear lighted array 15, the user can see how wide the display is on the front side and that it is centered in the swing. Audible and tactile feedback is also provided to the user by the inertial reversal sensor 28 as the device is swung back and forth. The rhythm the sensor generates makes synchronizing the display easy.

A microcontroller 26 is mounted on the printed circuit board (PCB) 24 and controls the lighted array 14 and any rear lighted array 15. This microcontroller 26 is responsible for controlling the lighted array 15 and adjusting it to the users swing width and centering the display within it. The swing width is measured by the microcontroller with the aid of an inertia reversal sensor 28 which detects inertia reversals in the users swing cycle. These are inflection points where the users swing changes direction.

The inertia reversal sensor 28 is mounted on the printed circuit assembly 20 within the lighted array 14. It is important that the inertia reversal sensor 28 be mounted within the lighted array 14 since it is to detect the motion of the lighted array 14. The inertia reversal sensor 28 is considered a member of the lighted array 14 and may be mounted at various positions within it. Alternate placements of the inertia reversal sensor 28 are shown to be top mounted sensor 30, bottom mounted sensor 32, or anywhere else inside the lighted array 14. The inertia reversal sensor 28 consists of a metallic bead 34 sliding on a metal wire 36. Metal bead slides freely on the metal wire 36, between the right sensor contact 38 and the left sensor contact 40.

A battery contact 42 is shown in FIG. 2 and contacts the positive side of the battery (not shown) and provides power for the circuit. The device can be powered from three M batteries for over a month. This low power battery operation is a great improvement over prior art.

The aforementioned inertia reversal sensor 28 is shown in FIG. 3 and consists of metallic bead 34 threaded onto a metal wire 36. The metallic bead 34 is free to slide back and forth on the metal wire 36. Right sensor contact 38 and left sensor contact 40 are grounded by the metallic bead 34 when the inertia of the device is reversed. The metal wire 36 and contacts 38 and 40 are connected to the printed circuit board (PCB) 24 by soldering to the copper traces 44 on the printed circuit board (PCB) 24. The sensor can be mounted over the top of other components 46 on the printed circuit board (PCB) 24 or the sensor can be mounted close to the surface of the printed circuit board (PCB) 24 such that the metallic bead 34 clears the printed circuit board (PCB) 24 and can slide freely. Left sensor contact 40 and right sensor contact 38 can be replaced with copper traces 44 if the sensor is mounted close to the printed circuit board (PCB) 24 surface.

FIG. 4 illustrates an alternate inertia reversal sensor 48 in the preferred embodiment. This alternate inertia reversal sensor 48 consists of a metallic slug 50 which slides freely in a metallic tube 52. The metallic tube 52 is either soldered directly to copper traces 44 on the printed circuit board (PCB) 24 or is mounted over the top of other components 46. Raising the alternate reversal sensor 48 above other components allows the circuit to be very compact and small since components are mounted over top of each other. Conductive tube mounts 54 are electrically connected to the metallic tube 52 and serve to attach it to the printed circuit board (PCB) 24 when mounting it on top of other components 46. The metallic slug 50 slides out the open ends of the metallic tube 52 and make electrical contact with the right sensor contact 38 and the left sensor contact 40 when the inertia of the alternate inertia reversal sensor 48 reverses.

The inertia reversal sensor 28 of FIG. 3 is used in the preferred embodiment to detect kinetic energy imposed on the device by the user. This provides a kinetic means for device activation, which eliminates the need for on/off or mode switches. The device is turned on by shaking it. This kinetic motion excites the inertia reversal sensor 28, which is interpreted by a microcontroller. In this way, the microcontroller can discriminate between different types and speeds of kinetic motions. The microcontroller is programmed to ignore the random kinetic actions that take place during shipping but turn on when it detects the device being waved at a predetermined rate. When the user stops waving the device, the lack of motion is sensed and the device turns off.

The invention operates in four states a shown in FIG. 5. The states are, Sleep 56, Test Kinetic Shake 58, Run 60, and Shutdown Warning 62. The invention detects the inertial reversals that it encounters with inertia reversal sensor 28 and changes its operational state based on what was detected. The following motions are detected: No Motion 64, Motion 66, Incorrect Shake Speed 68, and Correct Shake Speed 70.

After battery insertion, the microcontroller initializes and goes into Sleep 56 state which is a low power mode in which all functions are disabled except for waiting to be interrupted and awakened when motion is detected by the inertia reversal sensor 28.

When Motion 66 is detected, the microcontroller wakes up, enters the Test Kinetic Shake 58 state, and waits for a predetermined number of inertia reversals occurring at a predetermined rate. In the preferred embodiment of the invention, this predetermined number of inertia reversals is three reversals in two seconds. If this rate and count of reversals is not detected, it is considered an Incorrect Shake Speed 68 condition and the Sleep 56 state is reentered. This shake speed check is critical since it prevents unintended functioning of the invention. It the Correct Shake Speed 70 is detected, the microprocessor enters the Run 60 state. During this state the visual display is performed and the microprocessor watches for the periodic inertial reversals which are caused by swinging the device back and forth. If the periodic inertial reversals stop, the microprocessor considers this a No Motion 64 detection and it enters the Shutdown Warning 62 state. In the Shutdown Warning 62 state, an indication is made to the user, by turning on one of the light emitting elements of the lighted array. This indicates that the device is about to turn off. If after a suitable delay, No Motion 64 is detected, the microprocessor turns off the device and enters the Sleep 56 state. If Motion 66 was detected while in the Shutdown Warning 62 state, the microcontroller returns to the Run 60 state and continues to generate the display. This return to the Run 60 state from the Shutdown Warning 62 state can also be used to reset what is displayed to an initial starting display.

One of the novel features of this invention is that the words and graphics, which are displayed, can be changed over time. As long as the device is waved in a back and forth motion, periodic inertial reversals are produced which are detected by the inertia reversal sensor 28. After a predetermined number of these inertial reversals or swings, the phrase that is being displayed can be changed. For example, "I LOVE YOU" can be displayed and after five swings the display is changed to "NEW YORK" and after five more swings the display is changed to "CITY". In this way, long sentences can be displayed, a phrase at a time, changing to the next phrase after a delay. The Shutdown Warning 62 state can be used to modify what is being displayed. If after displaying "I LOVE YOU", the user stops waving the device, the Shutdown Warning 62 state will be entered by the microprocessor and a visual warning will be given to the use of an impending shutdown. If the user resumes waving the device back and forth, the sentence will be reset to its initial starting display and again it will display "I LOVE YOU". By modifying and pausing the swing motion of the device, the user can modify what the device is displaying. Instead of displaying admiration for New York, the user can display feelings for a passerby.

Words, phrases, and graphics to be displayed can be organized into groups. Many different types of display modes are possible by displaying phrases and groups of phrases in differing ways. For example, if there are seven groups of phrases and seven or more light emitting elements in the array, the light emitting elements can be used as a menu, to select a group for display. The first light corresponds to the first group, the second light element corresponds to the second group and so on. As the light elements are illuminated, the user can begin to wave the device when the light, which corresponds to the group he wishes to select, is reached. The following display modes are illustrative of what is possible.

Single Group: All phrases are grouped together into one large group, which is repeated.

Random Group: Phrases are arranged into groups. A group is selected at random by the microcontroller and displayed, ending with the last phrase in the group repeated.

Random Group Change: A group is selected at random by the microcontroller and displayed. Thereafter another random group is selected and displayed, and so on.

Random Group Start: The first group displayed is selected at random by the microcontroller. Thereafter all phrases in all groups are displayed in turn from that starting point.

Selected Group: A menu system is presented to the user, whereby the user is able to select the group of phrases to display by lighting the elements of the lighted array in turn, each light indicating a group of phrases. When the desired light is lit by the microcontroller the user beings to wave the device back and forth. This kinetic motion is detected by the microcontroller and interpreted as a selection of that group. For example, if the second light is lit when the user starts waving the device, the second group has been selected. If the user waves the device when the sixth light is lit, the sixth group will be selected. The selected group is then displayed.

Selected Start: A menu system is presented to the user, whereby the user is able to select the group of phrases to display by lighting the elements of the lighted array in turn, each light indicating a group of phrases. When the desired light is lit by the microcontroller the user beings to wave the device back and forth. This kinetic motion is detected by the microcontroller and interpreted as a selected on that group. For example, if the second light is lit when the user starts waving the device, the second group has been selected. If the user waves the device when the sixth light is lit, the sixth group will be selected. The selected group is then displayed. Thereafter all phrases in all groups are displayed in turn from that starting point.

Random Phrase: A phrase is selected at random by the microcontroller and displayed. Thereafter another random phrase is selected and displayed, and so on.

Many other modes are possible since when the last phrase in a group is reached, different modes could be realized by repeating the same phrase group repeatedly, or ending on the last phrase in the group and display it endlessly, or automatically moving on to the next group. This list is only a sample of the many modes of operation, which are possible with the present invention.

The display data is stored in an encrypted fashion so that the maximum amount of data can be stored in the microcontroller memory. The preferred embodiment encrypts the data by removing all spaces and only using capital letters. Every time a small case letter appears in the data, it indicates that the letter should be preceded with a space, and an upper case version of the letter is inserted in the display.

The visual display is produced by displaying a column of data at a time. A dot matrix is employed for drawing alphanumeric and graphic characters. Each column of the dot matrix is displayed one at a time on the lighted array 14 shown in FIG. 2 in a columnar piecewise fashion. The lighted array is moved through space by the user, the effect of which, is to spread the visual display in a linear direction. The back and forth motion of the device allows the human eye to capture each vertical piecewise image and store them using the "after image" effect of human vision. The human brain blends the vertical piecewise images into a complete perceivable image.

Experiments have shown that if light emitting diodes are used as the light emitting element 22 of the lighted array 14, a superior effect is achieved if obscured, pigmented, or tinted light emitting diodes are used rather and the water clear light emitting diodes. This is due to the fact that the lighted array 14 is in motion when it is viewed. Obscured light emitting diodes appear as larger, evenly colored light elements while water clear light emitting diodes appear as small but bright, points of light. The "after image effect" is dependent on the observer viewing the light illuminating the lighted array 14 itself, not the light projecting from the surface of the array onto the observers eye.

The device is programmed to display words and graphics in the central part of the users swing. This is done by measuring the users half-cycle swing width and adapting the display time for each column of data so that all one hundred twenty eight columns (predetermined maximum number of columns in a display for the preferred embodiment.) fit within the half-cycle swing width.

FIG. 6 is a flow chart of the display method. It begins with the device Wake Up 72, which occurs when the stick is shaken rapidly. The device then will Display Column 74 of data. This will illuminate the lighted array with the columnar data. Count Column 76 keeps track of the number of columns displayed. This count is used to measure the users half-cycle swing width and it will be used hereafter to calculate a new column delay time. The device then checks to see if the sensor has detected the right most extreme of the swing cycle, Detected Right Inertia Reversal? 78. If this right inertia reversal has been found, the device will then check to see if it has detected the left most extreme of the swing cycle, Detected Left Inertia Reversal? 88. The device will wait here for the left inertia reversal detection. Adjacent inertia reversals define a half-cycle swing width of the user. A complete swing cycle being from the left most extreme of the users swing, to the right most extreme of the users swing, and back to the left most extreme of the swing. Thus we are sampling the users swing cycle according to the Nyquist criterion thereby enabling the controller to actively normalize the display and repeatedly position the display within the half-cycle swing width. Prior art measured whole wave cycle widths using interval timers and accelerometers. Because of the unique inertia reversal sensor, the cycle widths are measured for each half-cycle swing width, doubling the measurement accuracy of the present invention over the prior art.

When the left inertial reversal has been found, the device will Calculate New Timing For Display 86. Since the preferred embodiment of the invention can display sixteen characters per swing, the number of vertical display columns per swing is calculated as sixteen characters times eight columns per character equals one hundred twenty eight columns per swing. (16 characters×8 columns per character=128 columns) The new timing calculated in Calculate New Timing For Display 86 is the column delay time or the amount of time the microcontroller displays each column of data before moving on to the next column of the display. The new column delay time is calculated each swing by multiplying the new column count by the column delay time of the previous swing. This is then divided by one hundred and twenty eight columns to derive the new column delay time, which is used, for the next display swing and we return to Display Column 74. In this way the column delay is normalized from swing to swing and we actively adjust the visual display. A running average of column delay times will produce a stable display, which is slower in response to changes in swing width and speed.

Now we will return to our discussion of the detection of the right most extreme of the swing cycle, Detected Right Inertia Reversal? 78. If the right inertia reversal is not detected, the device will check for timeout 80 condition. The timeout condition occurs when the device has not been waved back and forth for the duration of the timeout period. If this right inertia reversal fails to come and the timeout condition occurs, the device will then Turn Off Display 90 and enter the Sleep 56 state. If the timeout condition does not occur, the device will check to see if it is Done With Display? 82. If the display is done, Display Blank Columns 84 are displayed and it returns to Count Column 76. Here again the device checks to Detected Right Inertia Reversal? 78. If the display is not done, the device returns to Display Column 74 and continues the operation. In this way we measure each wave of the device in column times.

This measurement is made without using an interval timer, which allows this device to be implemented with microcontrollers, which do not have interval timers. The count of displayed columns is adequate for measurement of the swing width since experience and practice has shown that good stable displays are produced in a relatively narrow range of swing speeds. In reality, the human arm can only move within a certain narrow range of swing speeds. Therefore the adjustment of the display does not have to be infinitely variable. The display adjustment need only be within a relatively small range. Thus, an exacting method of measuring swing, such as an accelerometer is not needed. The present invention succeeds in adjusting the display for easy readability while using low cost sensor and means.

The device is able to display words and phrases of differing lengths. In order to ensure that each word appears in the center of the users, swing, the device counts the character count of each phrase that is to be displayed. This character count is then multiplied by the number of columns required to display them. This sum is then subtracted from the total column count of the users half-cycle swing width. This remainder is then divided by two. This final value is the number of columns that are displayed as blank before the phrase is displayed. This makes sure the phrase is centered in the users swing. In the preferred embodiment, the phrase is displayed as the device is swung from left to right. The return swing, right to left is used to measure the swing length and resynchronize the display. Attempting to display on both swings with a hand held device would produce a jittery display that would be unacceptable.

Other Embodiments

360 Degree Device—Description

Figure 7:
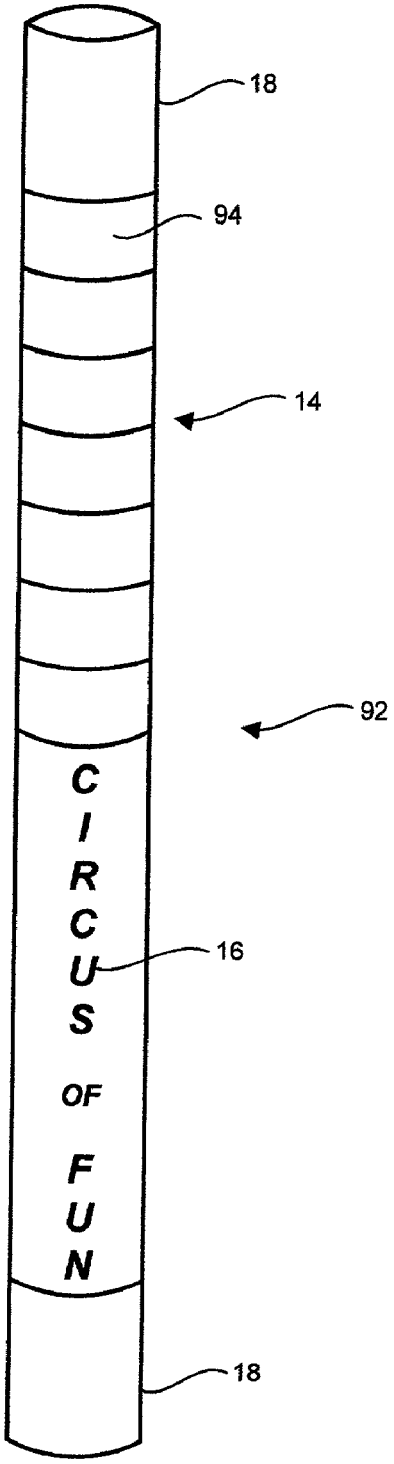
FIG. 7 is an alternate embodiment of the invention, which is capable of producing stable displays throughout 360 degrees of motion.

FIG. 7 is a 360 degree light stick 92 which consists of a lighted array 14 which is made up of a multiplicity of cylindrical light emitting element 94. The embodiment is fitted with end cap 18 and handle 16, which allows the invention to be grasp while swinging it back and forth.

Figure 8:
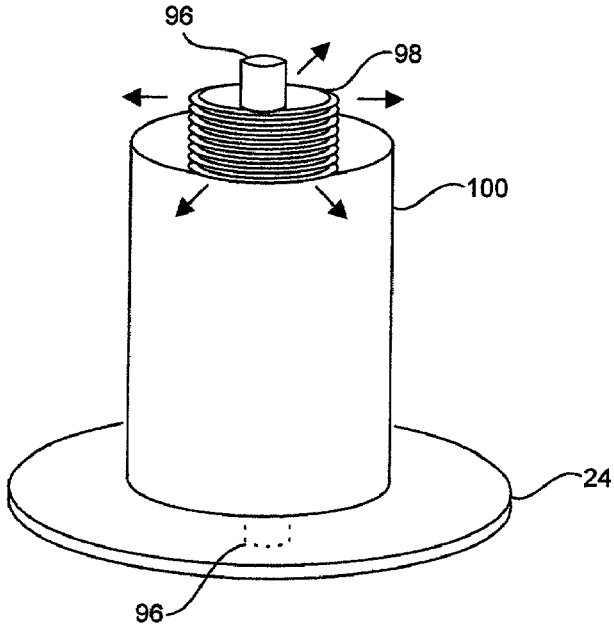
FIG. 8 is an inertia reversal sensor, which detects inertia reversals throughout a 360-degree radius.
Figure 9:
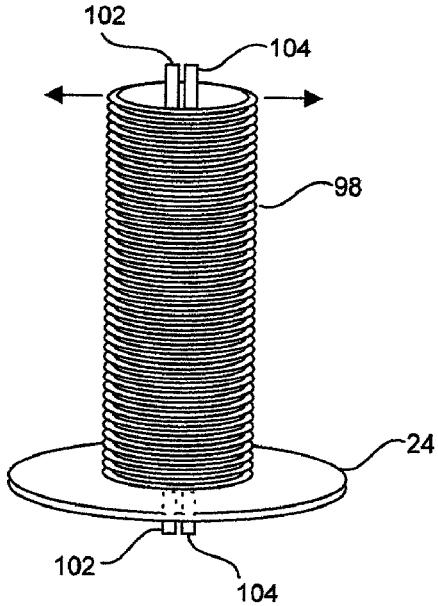
FIG. 9 is an inertia reversal sensor, which detects inertia reversals throughout a 270-degree radius.

Motion of the 360 degree light stick 92 is detected with a multi-degree sensor such as the ones drawn in FIG. 8 and FIG. 9. The sensor of FIG. 8 consists of a central metallic post 96, a concentric metallic spring 98, and a concentric metallic cylinder 100 mounted on a printed circuit board (PCB) 24. The sensor of FIG. 9 consists of a left metallic post 102, and a right metallic post 104, which are mounted to printed circuit board (PCB) 24 in close proximity but not contacting each other. The left metallic post 102 and right metallic post 104 are mounted in the center of a concentric metallic spring 98.

360 Degree Device—Operation

The alternate embodiment of the invention shown in FIG. 7 is a 360 degree light stick 92 which enables the user to swing the invention in any two opposing directions and produce a pleasing display. This is especially helpful for younger users of the invention who have not yet developed motor skills, which allow constant repeatable swings of the device. Since the lighted array 14 is made up of cylindrical light emitting element 94 which encircle the device, the display is visible in 360 degrees of rotation around the device.

Motion of the 360 degree light stick can be detected with a multi-degree sensor such as the ones drawn in FIG. 8 or FIG. 9. The sensor of FIG. 8 consists of a central metallic post 96, and a concentric metallic cylinder 100 are mounted in close proximity on a printed circuit board (PCB) 24. Central metallic post 96 and concentric metallic cylinder 100 form the electrodes of a inertia reversal sensor. Between the two electrodes is placed concentric metallic spring 98 which is fixed to printed circuit board (PCB) 24 at one end, such that it is free to swing at the top end. When the inertia changes direction, the concentric metallic spring 98 distorts and is forced to make contact with both the central metallic post 96 and the concentric metallic cylinder 100. By detecting and processing these inertial reversals, a microprocessor can produce a stable visual display.

The sensor in FIG. 9 may also be employed to detect inertia reversal in nearly 360 degrees of swing rotation. Left metallic post 102 and right metallic post 104 are centrally located in a concentric metallic spring 98. The posts are placed close to each other but not contacting. They are fixed to a printed circuit board (PCB) 24 and the concentric metallic spring 98 is also fixed at the bottom to the printed circuit board (PCB) 24 such that its position relative to the central posts does not change at its base, near the printed circuit board (PCB) 24, but it is free to move at the top end of the concentric metallic spring 98. When the inertia changes direction, the concentric metallic spring 98 distorts and is forced to make contact with both the left metallic post 102 and right metallic post 104. By detecting and processing these inertial reversals, a microprocessor can produce a stable visual display.

Other aspects of this alternate embodiment of the invention are similar to the preferred embodiment of the invention.

Subliminal Mode—Description

Figure 10:
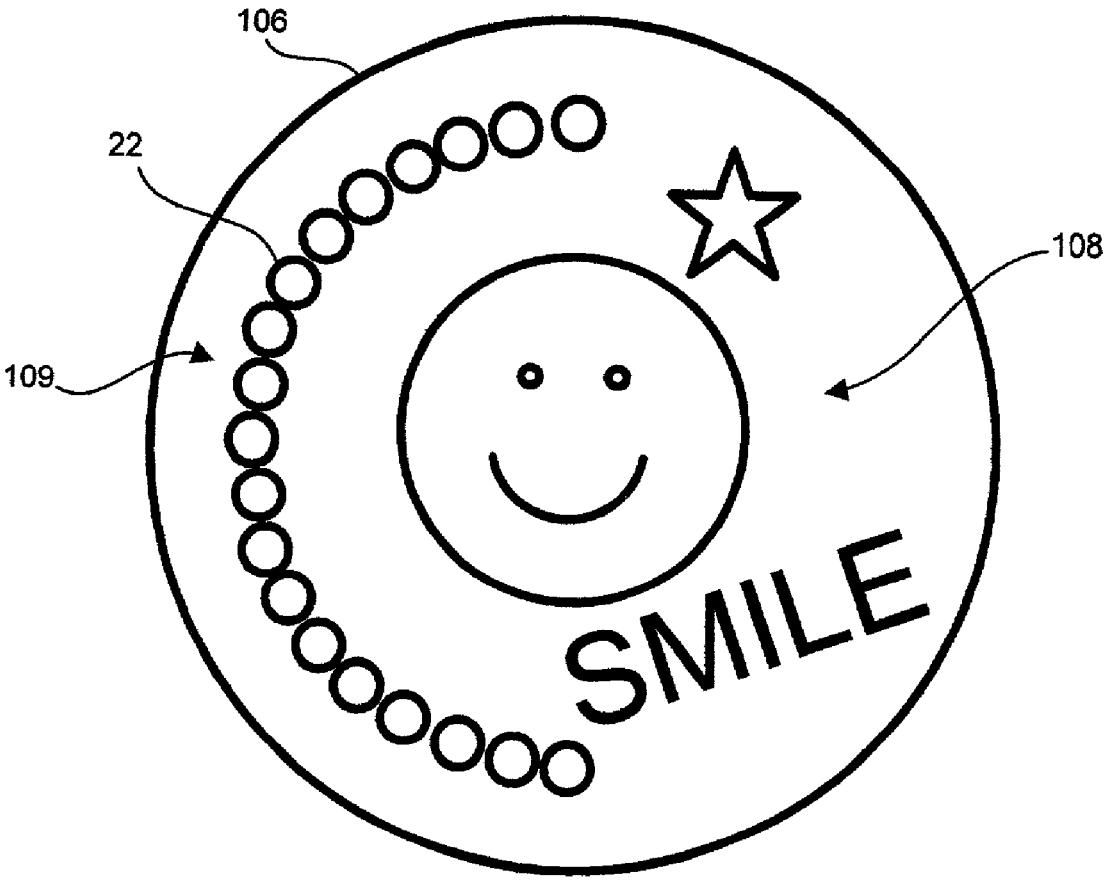
FIG. 10 shows an alternate embodiment of the invention integrated into a badge.
Figure 11A:
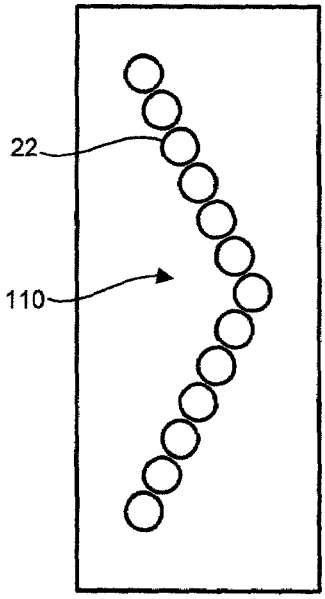
FIG. 11A is an alternate embodiment of the invention, which guides the human eye in the desired direction to produce a "subliminal" display.
Figure 11B:
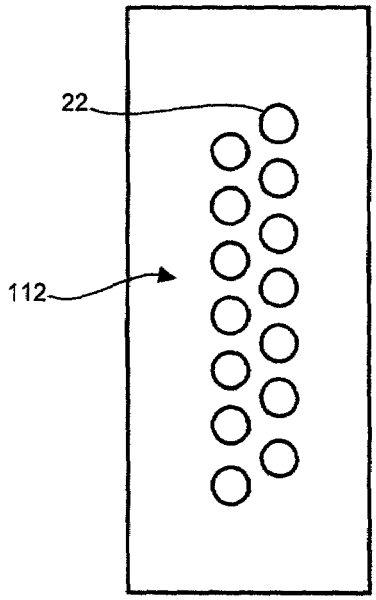
FIG. 11B is an alternate embodiment, which consists of two offset rows of light emitting elements to produce high-resolution displays.

FIG. 10, FIG. 11A, and FIG. 11B show alternate embodiments of the invention, which make use of what we call subliminal mode.

FIG. 10 shows an embodiment of the invention, which is integrated, into a badge 106. The badge is imprinted with a graphic design 108 or textual information. The badge has a curved lighted array 109 which is made up of a plurality of light emitting element 22 built into the face of the badge.

FIG. 11A shows an embodiment of the invention which has an angled lighted array 110 made up of light emitting element 22.

FIG. 11B shows an embodiment of the invention, which makes use of two offset lighted arrays 112 made up of light emitting element 22.

Subliminal Mode—Operation

The subliminal mode embodiment relies on the movement of the observer to produce the desired image. A microcontroller is programmed to display the desired image in a columnar piecewise fashion. The lighted array is active and the observer at first sees merely an array of blinking lights. As an observer scans his eyes across the lighted array, an image is perceived by the observer. At a distance, this embodiment of the invention will produce displays, which seem to appear out of thin air. Periodically, the stereo-optic properties of the human eye and brain will enhance the effect and a display that is twice as big, or greater, as the lighted array will be perceived. If a lighted array operating in the subliminal mode is physically moved back and forth through the air, a display will be produced similar to the preferred embodiment except it is not adjusted and normalized by means of an inertia reversal sensor.

An alternate embodiment of the invention is a badge 106 as shown in FIG. 10. The badge is worn on the lapel or shirt of a user. The badge is decorated with any desired graphic design 108 or textual information as with any normal badge. The badge 106 is also fitted with a curved lighted array 109 which is made up of a plurality of light emitting element 22. As shown in FIG. 10, the lighted array may consist of any desired number of light emitting element 22. In this embodiment the curved lighted array 109 is curved to conform to the radius of the circular badge, however an inline vertical array could just as easily be employed to produce this display.

If the lighted array is curved as in FIG. 10 or is an angled lighted array 110 as in FIG. 11A, the microcontroller must adjust the timing of the columnar piecewise data so it is perceived as correctly aligned by the observer. Individual light emitting element 22 are energized in turn to produce the effect.

If the eyes of the viewer are scanned in the opposite direction from the direction the microcontroller is displaying the vertical image slices, the image will appear reversed. This display reversal adds to the wonder of the effect but can be controlled by giving the viewer subconscious clues as to which way to scan his eyes past the lighted array. This is done by making use of a curved lighted array 109 as shown in FIG. 10 or by using a angled lighted array 110 as shown in the lighted array 14 of FIG. 11*a*. This curved or angled lighted array 14 usually causes the viewers eyes to scan the array from left to right and if the microcontroller is programmed to display from left to right, the display will be observed to be correctly oriented. This same effect is possible with a forward "/" or backward "\" slanted array or arrays pointing left "<" or pointing right ">".

FIG. 11B makes use of offset lighted arrays 112 which has the effect of producing a higher density display. Gaps in the visual display are filled in by the offset rows of light emitting element 22 in the lighted array, to produce a less granular image. Microcontroller timing of the array is controlled such that the offset columns of the display are energized in time to produce a solid display. It follows that this embodiment may be integrated into any number of products such as articles of clothing, hats, signs, flag poles, car antenna, or other stationary or moving objects to produce pleasing visual displays.

Rotational Mode—Description

Rotational mode is an embodiment of the invention that employs a lighted array, which is rotated. The rotating display can be synchronized or free running.

Rotational Mode—Operation

A lighted array 14 as shown in FIG. 2 of the preferred embodiment or an angled lighted array 110 of FIG. 1A or offset lighted arrays 112 of FIG. 11B can be rotated around an axis to produce a pleasing display. This rotation can be manual or motorized and can be synchronized with a rotational position sensor or free running. By adjusting the display speed various display effects can be achieved which are very pleasing and eye catching. Adjusting the speed of the rotation can make the display precede, recede, or appear stable, as the lighted array 14 sweeps rotationally around the circumference of a circle. A rotational position sensor can detect when the lighted array 14 is in the lower half of the circle and adjust the display so it is correctly oriented with no inverted characters or graphics.

It follows that such displays would be very effective in advertising such as store window displays. Display data can be changed through keyboard, or wireless means.

"Character at a Time" Displays—Description

Figure 11C:
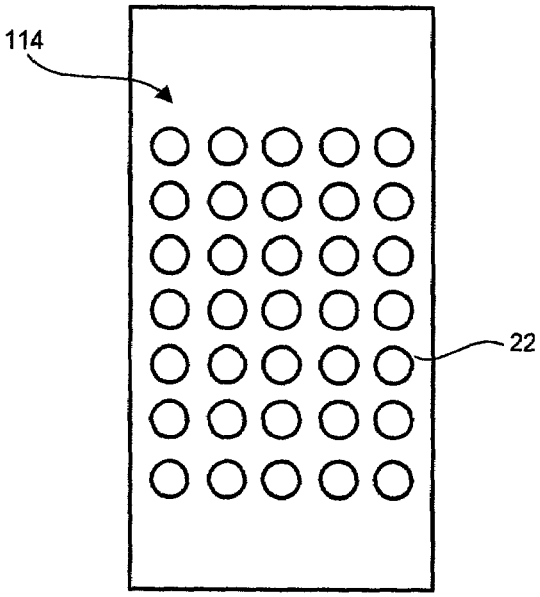
FIG. 11C is an alternate embodiment of the invention, which employs a five by seven array of light elements to produce a display.

FIG. 11C shows an alternate embodiment of the invention, which makes use of a character lighted array 114, which displays a whole character at a time. The character lighted array 114 is made up of a plurality of light emitting element 22.

"Character at a Time" Displays—Operation

"Character at a time" displays make use of whole character lighted array 114 shown in FIG. 11C, which in turn is made up of a plurality of light emitting element 22. Instead of displaying data in a columnar piecewise fashion, this alternate embodiment displays a complete character or graphic at a time. The microcontroller then delays for a character delay period and then moves on to the next character. The net effect is that the characters or graphics are displayed in the air, a "character at a time." Any kind of character display may be used, such as seven segment displays, alphanumeric displays, or the dot matrix display shown in FIG. 11C.

Picture Displays—Description

Figure 11D:
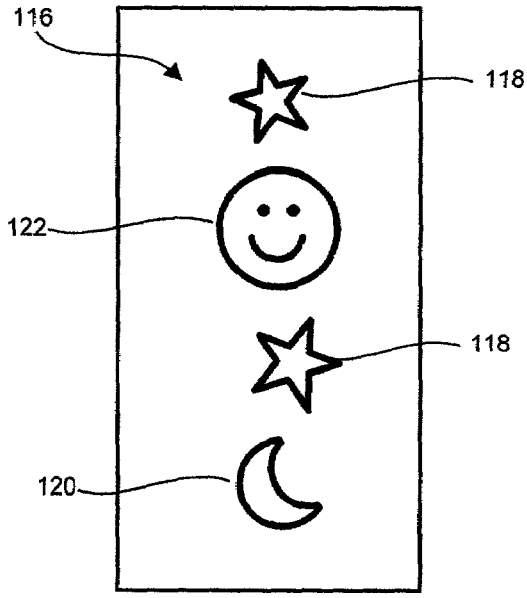
FIG. 11D is an alternate embodiment of the invention which displays pictures instead of words using the "persistence of vision" effect.

FIG. 11D illustrates a picture lighted array 116 which is made up of a single or a plurality of light emitting elements in the shape of picture objects. This picture display is made up of a star light element 118, moon light element 120, and a smile face light element 122.

Picture Displays—Operation

FIG. 11D is an example of an alternate embodiment of the invention, which displays pictures and shapes. This example device will display stars, moon, and happy face shapes as the device is moved through the air. A microcontroller turns the lighted star light element 118, moon light element 120, and smile face light element 122 on and off at a high rate of speed according to a predetermined pattern. When the device is stationary it looks like rapidly blinking shapes. Then the device is moved through the air the shapes appear and re-appear in the air as the device is moved. This effect is caused by the "after image" effect of human eyesight. It follows that if this embodiment were built into a toy magic wand, for example, as the wand was moved through the air, stars, moons, and happy faces would appear in the air trailing from the wand like "magic dust". Electronic sparklers and many other electronic fireworks displays are possible with this embodiment of the invention.

Kinetic Light Puzzle—Description

Figure 12A:
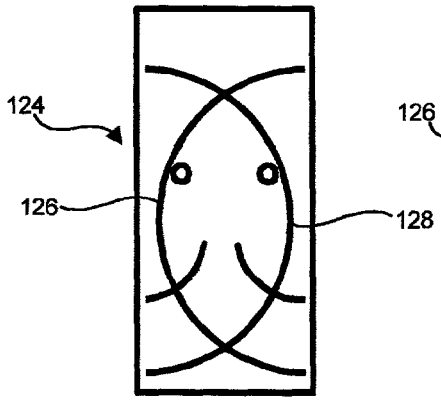
FIG. 12A shows alternate embodiment of the invention, which forms a kinetic light puzzle.

FIG. 12A illustrates an alternate embodiment of the invention, which forms a light puzzle 124. The illustrated light puzzle 124 consists of two parts: left puzzle light array 126 and right puzzle light array 128.

Figure 12B:
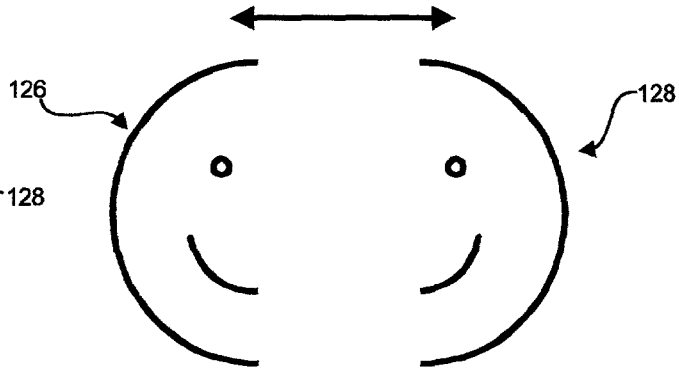
FIG. 12B shows the display produced by alternate embodiment in FIG. 12A.

FIG. 12B shows how the display appears when the invention is in motion back and forth. Left puzzle light array 126 and right puzzle light array 128 are displayed for the viewer.

Figure 12C:
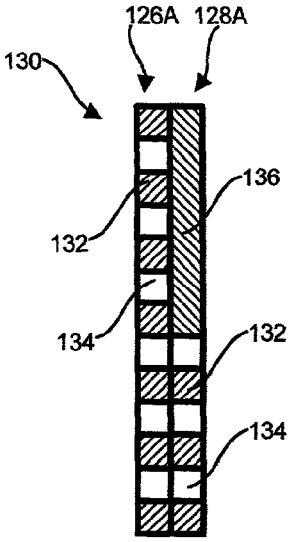
FIG. 12C shows an alternate embodiment of the invention, which comprises a kinetic light puzzle, which can display an American flag.

FIG. 12C shows a kinetic light puzzle, which generates an American flag when it is in motion. The compound lighted array 130 consists of two vertical elements, namely a left puzzle light array 126A which is made up of red element 132 and white element 134, and a right puzzle light array 128A which is made up of red element 132, white element 134, and blue element 136.

Figure 12D:
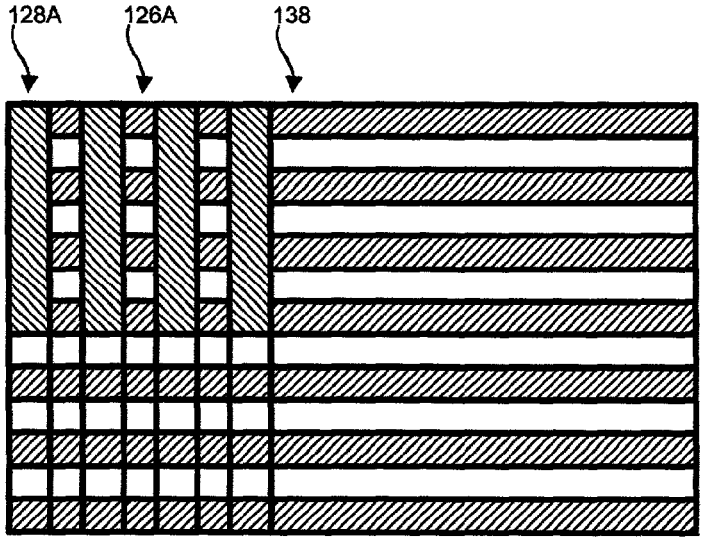
FIG. 12D shows a display that is produced by the kinetic light puzzle in FIG. 12C.

FIG. 12D shows an American flag display, which is produced by the compound lighted array 130 shown in FIG. 12C. The flag is made up of alternating columns of right puzzle light array 128A and left puzzle light array 126A. The striped portion 138 of the American flag is generated using the left puzzle light array 126A.

Kinetic Light Puzzle—Operation

An alternate embodiment of the invention is the light puzzle 124 of FIG. 12A. A light puzzle is made up of left puzzle light array 126 and a right puzzle light array 128. These left and right sides of the puzzle overlap in this example and are independently manipulated by a microcontroller. As the device is moved back and forth through the air, an inertia reversal sensor detects when the device changes direction. The left puzzle light array 126 is energized and then the right puzzle light array 128 is energized. The image is displayed in the air within the range of two inertia reversals caused by swinging the device back and forth. The object of the puzzle is to swing the device at just the right speed in order to bring the two parts of the puzzle together and form a complete image. FIG. 12B shows left puzzle light array 126 and right puzzle light array 128 as they are moved back and forth through the air, before a complete image is formed. A happy face is displayed in the air when the speed of the users swing is correct.

Light puzzles can be used to draw any graphic, which lends itself to this form of display.

Another form of light puzzle is able to draw a full color American Flag in mid air when the device is waved at the correct speed. FIG. 12C shows a kinetic light puzzle, which generates an American flag when it is in motion. The compound lighted array 130 consists of two vertical elements, namely a left puzzle light array 126A which is made up of red element 132 and white element 134, and a right puzzle light array 128A which is made up of red element 132, white element 134, and blue element 136. The right puzzle light array 128A and the left puzzle light array 126A are under the control of a microcontroller or other clocking circuit which blinks them on and off in a predetermined pattern to produce an American flag.

FIG. 12D shows an American flag display, which is produced by the compound lighted array 130 shown in FIG. 12C. The flag is made up of alternating columns of right puzzle light array 128A and left puzzle light array 126A. The striped portion 138 of the American flag is generated using the left puzzle light array 126A. When the striped portion 138 is displayed, the right puzzle light array 128A is turned off and the left puzzle light array 126A is turned on. The compound lighted array 130 is turned off after the flag is displayed to provide separation between successive flags. The compound lighted array 130 can be implemented in many other similar methods to produce a similar flag display. Some of these similar methods include using white light with red, white, and blue filters to draw the American flag, or using colored light, or "glow in the dark" colors in the lighted array 130.

CONCLUSIONS, RAMIFICATIONS, AND SCOPE

Thus the reader will see that the kinetic visual display of the invention provides a highly reliable, lightweight, low cost device which produces stable, pleasing, and readable visual displays, in any of several modes, relying on the "after image effect" or "persistence of vision" effect of human eyesight. It is usable by persons of almost any age for amusement, advertising, or other display applications. The user of the device is provided with visual or audio feedback, which allows the user to be aware of what is being displayed. This allows the user to adapt the motions of the device to produce various effects, such as wide or narrow characters or fast or slow visuals. The device is easy to operate since it senses the kinetic actions of the user and turns on, and begins the display. The user must simply begin waving the device back and forth and the display initializes and begins the display. Multiple modes of operation allow the user to select what is being displayed, or allows the random selection of display data or allows the grouping of display data, such that the user is guided to desired displays or even hidden display data. Large number of pre-programmed display data is possible since the data is stored in compressed format. Data may also be downloaded to the device for display through wired or wireless means. Users of the device, find it amusing, exciting, entertaining, and pleasurable experience. The combined effects of motion, light, sound, and user feedback make the device very fun and exhilarating to use.

Although the description above contains many specificities, these should not be construed as limiting the scope of the invention but as merely providing illustrations of some of the presently preferred embodiments of this invention. Various other embodiments and ramifications are possible within it's scope. For example, any of many available microcontrollers could be used to sense kinetic motions and produce the visual display since the display algorithm does not require the use of an interval timer, analog to digital converter, or other complicated peripheral. The microcontroller die could be directly attached to the printed circuit board using "chip on board' type technology, which would produce further cost savings in the device. Additional memory could be added to provide more display data in the invention. The lighted array 14 could be implemented in any color of light emitting element, namely red, green, yellow, blue, orange, white, or any combination of these or other colors could be used to produce pleasing kinetic visual displays. Changes in the size of the lighted array 14 are also possible over a wide range or arrays from less than an inch in height, to a very large array mounted to the side of a building.

Multiple lighted array 14 displays are possible which produce visual displays by grouping and timing display data across the arrays such that a complete image is produced. Multiple arrays could be placed along a train line or roadside, which produce text and graphic images when the observer moves past the lighted array 14.

A device operating in the subliminal mode could be attached to a vehicle such as an automobile, train, airplane, or other moving object such as a Ferris wheel, roller coaster, an automobile hubcap, radio antennae, or even a windshield wiper blade to produce kinetic visual displays which are viewable by a stationary observer.

Again, a kinetic visual display can be mounted in a store window on a rotating platform. When activated, the rotating platform will appear to have text and graphics display around the circumference of the rotating platform. The display then can be used to direct shoppers to sales and other specials.

Advertising phrases can be programmed into the invention and advertising can be printed on its handle. An advertising directed device could be given away as a premium, since the costs of the producing the device are paid for by the advertisers.

Kinetic visual displays could be used as a computer peripheral for the display of data from personal computers, personal digital assistants, servers, and even mainframes. Wired or wireless means can be added to the device to allow interconnection with other computing devices.

Games can be played with the device, such as, long distance, two way signaling across an arena, playing "capture the flag", and other games as well as electronic sparklers or fireworks, and cheering for a performer or player. The kinetic light puzzle embodiment of the invention can produce full color American flags, or any other graphic image, which is visible if moved in the proper manner.

A magic wand can be produced using the kinetic picture display embodiment which appears to have "magic dust" consisting of stars, moons, and other graphic shapes coming from the magic wand.

The device can be programmed to display differing visuals when it is moved with differing kinetic actions. One display is made when the device is moved in a fast "chopping motion", and a different display is made when the device is waved in a steady "wiping" motion.

The invention could be used as an exercise aid with a whole set of exercises designed to flex and contract muscles of the upper body and arms. When the exercise is properly performed, the correct display is produced by the device, visible to the user and any other observers. The display could even display positive encouragement such as, "FEEL THE BURN!" to the exerciser, or indications that more effort is required such as, "WAVE FASTER".

Kinetic visual displays can be built into automobile rear and side mirrors, or other parts of a vehicle, such that viewers are able to see "TURNING LEFT" when the turn signal is engaged or other similar display.

The kinetic visual display could be used to communicate on the freeway between moving cars. Displays of "SLOW DOWN!" or "NO TAILGATING" or other such displays are possible.

Kinetic visual displays can be integrated into articles of clothing or other objects and produce pleasing visual displays.

Other means of detecting inertia reversals can be devised and exist in practice. Thus the scope of the invention should be determined by the appended claims and their legal equivalents, rather than by the examples given.

I claim:

1. An apparatus for producing visual displays comprising:

at least one lighted array comprised of at least one light emitting element and defining a style of predetermined graphics shape or alphanumeric characters;

a double-throw inertia reversal sensor for sensing reversals in the direction of inertia; and a controller in communication with said array and programmed to count a number of adjacent inertia reversals detected by said inertia reversal sensor and to modify the display data delivered in a columnar piecewise fashion to said lighted array;

whereby a series of changing styles of graphics or alphanumeric characters appear and hang in mid air when the device is moved through space.

2. A kinetic apparatus for producing visual displays based on the persistence of vision effect of human vision, comprising:

a lighted array of light emitting elements;

a controller coupled to the elements of the lighted array; said controller being programmed to deliver display data in a piecewise fashion to said lighted array; and a multi-degree sensor for detecting angular motion of said lighted array; said controller being programmed to process changes in inertia detected by said multi-degree sensor;

wherein said apparatus is mounted for pivotal movement about a central point, such that the lighted array rotates at a variable speed around the circumference of a circle, thereby producing a visual display of text or graphics which appears stable or precedes or recedes around said central pivot point.

3. A device for producing visual displays based on the persistence of vision effect of human vision, comprising:

a lighted array of light emitting elements;

a controller to deliver display data in a columnar piecewise fashion to the lighted array;

wherein the lighted array is substantially fixed in position and relies on an observer to provide the kinetic motion required to produce a persistence of vision image by scanning the observer's eyes past the lighted array;

and wherein the lighted array is slanted, arched, angled, or pointed, such that the eyes of the observer are thereby guided to scan the array in the direction pointed to by the array, so that the observer will see a persistence of vision image which is correctly oriented when the observer's eyes scan in the direction indicated.

4. The apparatus of claim 3 wherein the array is integrated into articles of clothing, notebooks, and other items; whereby a visual display is produced when the viewer's eyes scan across the lighted array.

5. An apparatus for producing visual displays based on the persistence of vision effect of human vision, comprising:

a lighted array of light emitting elements;

a controller to deliver display data in a columnar piecewise fashion to the lighted array;

an inertia reversal sensor to detect the completion of a first half-cycle swing of the lighted array from a first position to a second position and to detect the completion of a return half-cycle swing of the lighted array from the second position back to the first position;

wherein the controller uses only the measure of the time interval between the completion of the first half-cycle swing and the completion of the return half-cycle swing to determine the timing of lighting sequence of the light emitting elements of the array during a display half-cycle swing immediately following the return half-cycle swing so that the image displayed by the lighted array is synchronized with the movement of the lighted array.

6. The apparatus of claim 5 wherein the display data is stored in a shorthand format; such that spaces are removed from the stored data but are implicitly indicated by changing the case of the stored character; thereby enabling the storage of substantially more display data while still being able to display spaces in proper places.

7. The apparatus of claim 5 wherein the controller randomly selects programmed data for entertaining display.

8. The display device of claim 5 wherein the lighted array is comprised of members selected from the group consisting of obscured light emitting diodes and pigmented light emitting diodes.

* * * * *